United States Patent [19]

Ross et al.

[11] Patent Number: 4,648,457

[45] Date of Patent: Mar. 10, 1987

[54] INJECTION CONTROL DEVICE FOR SUBTERRANEAN WELL CONDUIT

[75] Inventors: Richard J. Ross; Joseph N. Klumpyan, both of Houston, Tex.

[73] Assignee: Baker Oil Tools, Inc., Orange, Calif.

[21] Appl. No.: 790,876

[22] Filed: Oct. 24, 1985

[51] Int. Cl.[4] ..... E21B 34/12

[52] U.S. Cl. ..... 166/332; 166/334; 166/373

[58] Field of Search ..... 166/317, 332, 334, 373, 166/386, 242, 73, 305.1

[56] References Cited

U.S. PATENT DOCUMENTS

| | | | |
|---|---|---|---|
| 2,974,922 | 3/1961 | Keithahn | 166/334 X |
| 3,335,802 | 8/1967 | Seyffert, III | 166/334 |
| 4,141,418 | 2/1979 | Nutter | 166/332 X |
| 4,485,876 | 12/1984 | Speller | 166/373 |
| 4,552,218 | 11/1985 | Ross et al. | 166/321 X |

*Primary Examiner*—Stephen J. Novosad
*Assistant Examiner*—David J. Bagnell
*Attorney, Agent, or Firm*—Norvell & Associates

[57] ABSTRACT

A downhole injection valve for selectively opening and closing the bore of a tubing string to permit the passage of chemical treatment fluid to a downhole tool comprises a first annular valve element mounted in a valve housing which is connected in a tubing string above the downhole tool. A slip joint is connected between the valve housing and the downhole tool to permit relative upward and downward movement of the valve housing with respect to the tool. A second annular valve element is disposed in surrounding relationship to a support rod which is inserted in the tubing string and supported at its bottom end by the downhole tool. Upward movement of the tubing string will then effect contact of the first annular valve element carried by the valve housing with the second annular valve element carried by the support rod, and thus move such elements into engagement and close all fluid flow through the bore of the tubing string. Conversely, downward movement of the tubing string will effect axial separation of the valve element carried by the support post. The support post may be removed by a fishing neck assemblage having a lost motion connection with the support post. The lost motion connection permits the operation of a bypass valve to equalize fluid pressure across the support post so that it may be conveniently removed by wireline.

15 Claims, 16 Drawing Figures

INJECTION CONTROL DEVICE FOR SUBTERRANEAN WELL CONDUIT

BACKGROUND OF THE INVENTION

1. Field of the Invention

The invention relates to a method and apparatus for effecting the opening and closing of a well conduit extending to a downhole tool to permit the injection of predetermined amounts of treating fluid down the conduit to the downhole tool.

2. History of the Prior Art

Many producing wells have low fluid levels i.e., the levels of fluid in the casing annulus surrounding the production conduit does not extend upwardly from a production zone to any substantial extent, hence the hydrostatic fluid pressure in the production conduit will always substantially exceed the fluid pressure existing in the casing annulus.

This presents a problem when it is desired to treat a production formation, or a portion thereof, with chemicals conventionally employed to enhance the productivity of wells. The perforation treating apparatus may be positioned so as to straddle a selected portion of the production zone and provide a fluid passage to such selected portion from the tubular work string or the production conduit. However, if it is only desired to inject a limited amount of chemical treating fluid into the selected portion of the production zone, this becomes a matter of some difficulty, since the low fluid pressure existing in the production zone would effectively drain any quantity of treating fluid contained in the tubular string. There is, therefore, a definitive need for an injection control valve which may be positioned in the tubular string conduit immediately above the downhole tool and controlled from the well surface to selectively open and close such conduit so as to permit only a predetermined amount of treating fluid to be supplied to the selected portion of the production zone being treated. Injection control valves for this purpose have been known in the prior art, but have employed either springs or fluid pressures to shift the valve between its open and closed positions. This necessarily means that careful adjustment of the valve must be made before it is lowered into the well, in order to insure that the valve will function under the pressure conditions existing at the downhole location where the valve is positioned. Since these conditions are never known with great accuracy, this means that much intelligent guessing has to be made with respect to the proper amount of spring force or the proper amount of fluid pressure required to insure the reliable operation of the injection valve from its closed to its open position for the required duration.

SUMMARY OF THE INVENTION

This invention provides a method and apparatus for reliably effecting the opening and closing of an injection control valve mechanism disposed downhole in a tubing string solely by movement of the tubing string. A slip joint permitting limited movement of the tubing string relative to the downhole tool is connected to the downhole tool. Immediately above the slip joint, a tubular valve housing is connected in series relationship between the tubing string and the slip joint. Thus, the valve housing may be raised a limited distance by the tubing string and then lowered an equal distance. The valve housing further provides a fixed mounting for an annular valve element within its bore.

A second annular valve element is mounted on a support rod assembly which is positioned in inserted relationship with respect to the housing. Such support rod assembly is normally vertically supported by an upwardly facing surface of the downhole tool. Thus, the support rod assembly may be inserted in the valve and slip joint assembly prior to running into the well, or it may be lowered into position by wireline after the downhole tool, slip joint, valve housing and tubular string have been run into the well to the desired depth.

In the collapsed position of the slip joint, the annular valving member carried by the valve housing is positioned in downwardly spaced relationship relative to the annular valve member surrounding the support rod assembly. Thus, an annular fluid passage is provided between the bore of the tubular string and the downhole tool to permit the passage of chemical treatment fluid into the downhole tool. When sufficient fluid has been supplied, the well operator elevates the tubing string by an amount sufficient to bring the first mentioned annular valving member into axially abutting engagement with the second mentioned annular valving member and effects a sealing of the annular passage around the support rod assembly, hence cuts off any further fluid flow from the tubular conduit into the downhole tool. The valve is positively closed regardless of the fluid pressures existing adjacent to the valve.

One of the annular valving members is provided with an annular elastomeric seal member to provide greater sealing security and the hydrostatic fluid pressure existing in the tubular string provides a downward force on the annular valve member carried by the support rod assembly to compress the annular elastomeric seal member between the two axially abutting valve member, thus assuring a good seal.

When it is desired to open the injection valve and restore flow of a chemical treatment fluid into the downhole tool, it is only necessary to add tubing weight to the slip joint which permits the valve housing to move downwardly and effects an opening of the annular passage between the support rod assembly and the bore of the valve housing.

A further feature of this invention lies in the fact that the support rod assembly may be conveniently removed at any time to provide a large diameter passage through the tubular string, valve housing and slip joint to the downhole tool. In order to effect such removal, the support rod is provided at its upper end with a fishing neck which is mounted for limited axial movement relative to the support rod. The fishing neck is provided with seals which, in the lowered position of the fishing neck, effect the closing of a small diameter axial fluid passage through the upper portion of the support rod assembly which bypasses the annular seal effected by the two annular valve members when such valve members are in their closed position. The fishing neck is then engaged by a suitable wireline tool and elevated through its limited travel relative to the support rod assembly to remove the seals carried by the fishing neck from the bypass fluid passage and permit equalization of fluid pressure above and below the support rod assembly. The further upward movement of the fishing neck by wireline will then readily effect the extraction of the support rod assembly, and the annular valve member mounted on the support rod, from the valve housing for removal to the surface by the wireline. Thus, a large diameter fluid conduit is established between the bore of the tubular string and the downhole tool.

The injection valve can, however, be restored at any time by merely again inserting the support rod assembly by wireline through the bores of the valve housing and slip joint until the bottom end of the support rod assembly rests on the supporting surface of the downhole tool, where upon the annular valving member carried by the support rod assembly will again be in position to cooperate with the annular valving member carried by the valve housing to perform the injection valving function.

Further advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1A:
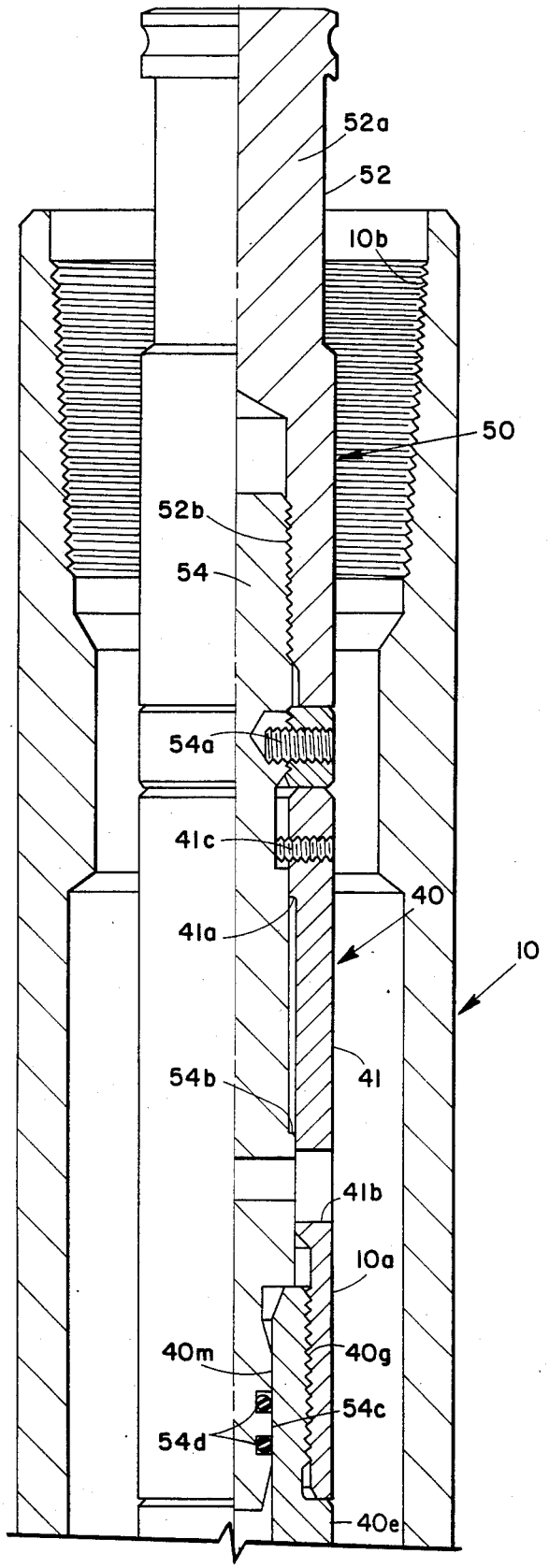
FIGS. 1A, 1B, 1C, 1D, 1E, and 1F collectively represent a vertical quarter sectional view of an injection valve mechanism embodying this invention, with the valve elements shown in their closed positions, with the packer shown only schematically in FIG. 1F.

Referring to the drawings, an injection valve mechanism embodying this invention comprises a series assemblage of three major tubular units between the bottom end of a tubing string and a conventional tool which is to be positioned at a desired location in the well by the tubing string. The top tubular unit comprises a valve housing assembly 10 which is connected at its top end to the bottom of the tubing string and at its bottom end to the top of a conventional slip joint 20. The bottom end of slip joint 20 is in turn conventionally connected to a mandrel or tubular conduit 30 extending to the downhole tool, which may comprise a washer, similar chemical treatment tool, or a packer 100 supporting a washer in adjacent relationship to a portion of a production formation for which chemical treatment is desired.

Valve housing assembly 10 comprises a tubular element 10*a* having internal threads 10*b* formed in its upper end for conventional securement to the bottom end of a tubing string. Internal threads 10*c* are provided in the bottom end of the tubular element 10*a* for connection to external threads provided on a connector sub 11. An O-ring 11*a* seals the threaded connection and a set screw 10*d* effects the securement of this threaded connection. The lower portion of the connector sub 11 is provided with internal threads 11*b* for attachment to a movable mandrel element 22 of the slip joint 20. An O-ring 11*c* seals this threaded connection and a set screw 11*d* effects the securement of the threaded connection.

Mandrel 22 is axially slidable relative to a slip joint housing assembly 24 which surrounds the lower portion of mandrel 22 and is provided at its lower end with internal threads 24*a* for engagement with the upper end of a mandrel or connecting conduit 30 which extends downwardly to a downhole injection tool or packer which is suitably anchored to the well casing.

The slip joint 20 is of conventional construction. The lower portion of the slip joint mandrel 22 is provided with one or more axially extending key ways 22*b* which are engaged by keys 26 which are held in rigid assemblage with the upper element 25 of the housing 24 by a key retainer sub 28 having internal threads 28*a* engagable with external threads in the lower end of the housing element 25. An O-ring 25*a* seals the threaded connection and a set screw 28*c* secures the threaded connection. Since the detailed construction of the slip joint 20 forms no part of this invention, further description is deemed unnecessary. It will, however, be obvious to those skilled in the art that the valve housing assembly 10 may be moved axially relative to the downhole tool or packer 100 secured to the lower mandrel or conduit 30 to the extent permitted by the limited axial movement of the slip joint mandrel 22 relative to the slip joint housing 24. An O-ring 24*b* in the upper end of the housing element 25 effects a sliding and sealing engagement with a cylindrical external portion 22*a* of the mandrel 22 during this axial movement.

Figure 1B:
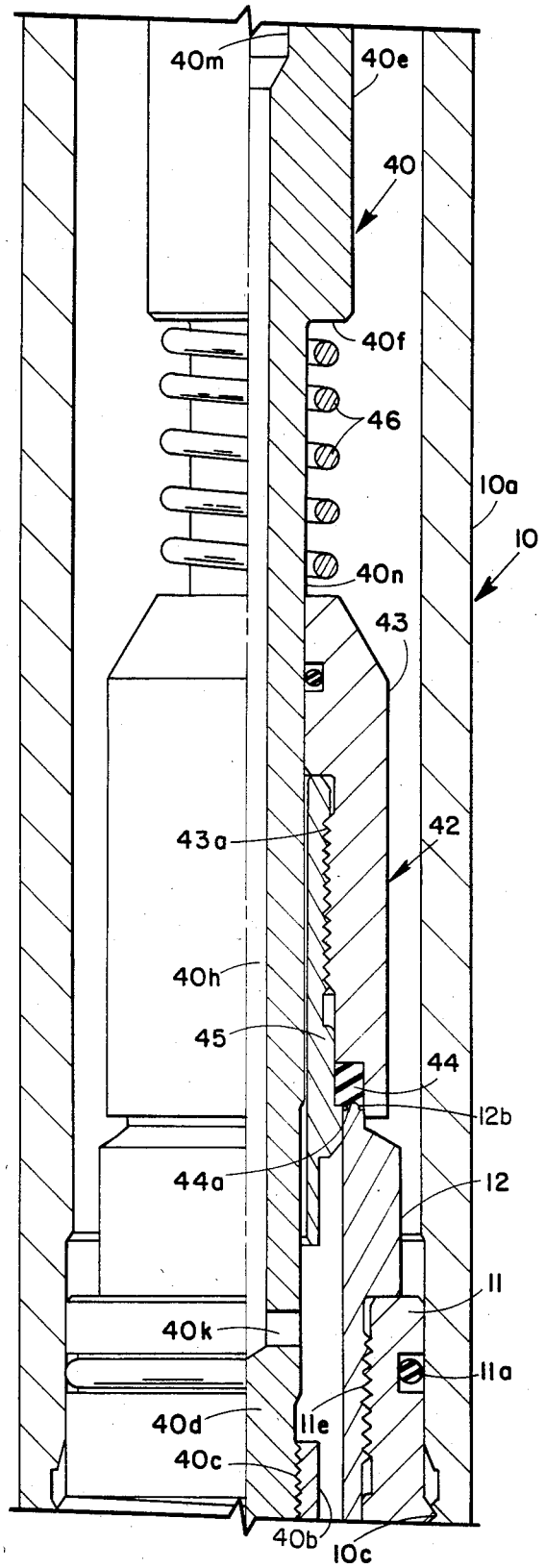
Figure 1C:
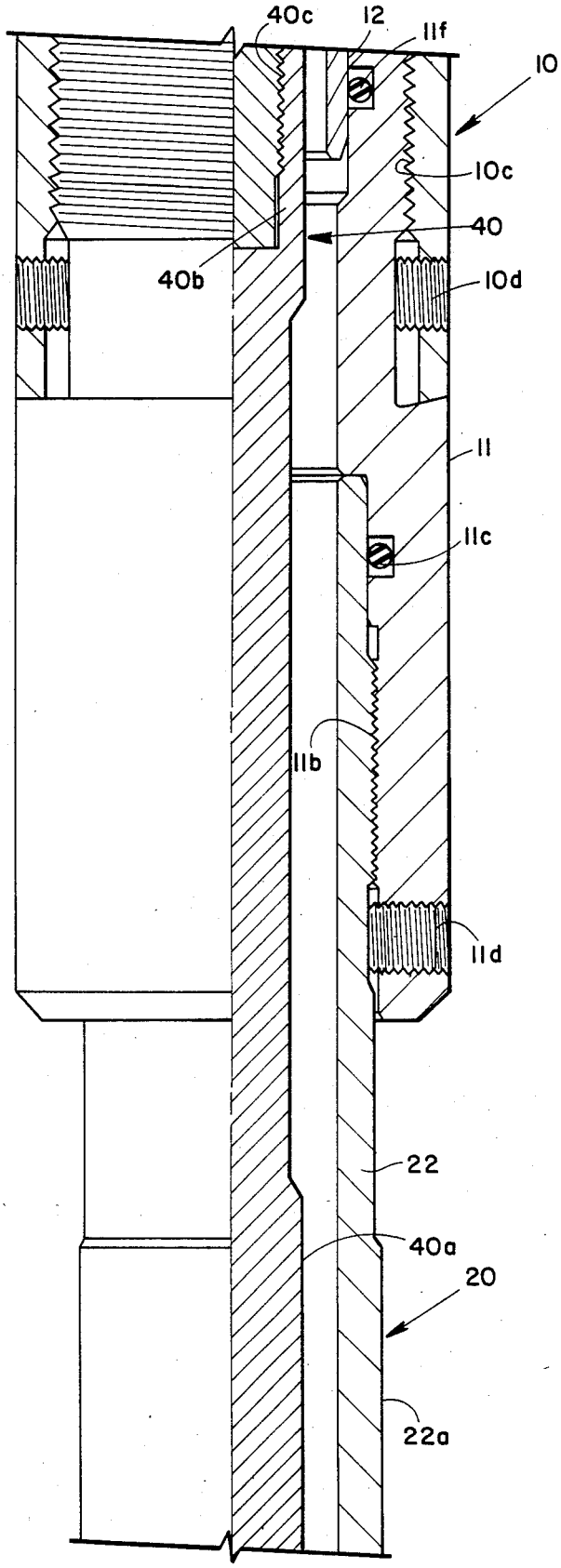
Figure 1D:
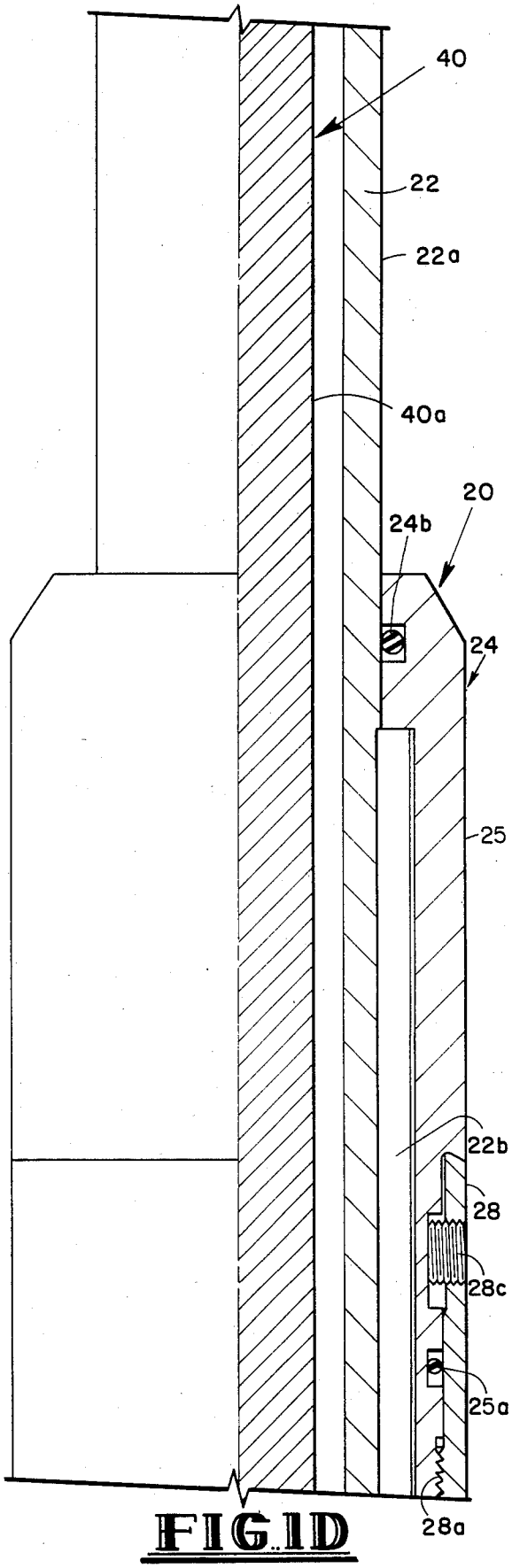
Figure 1E:
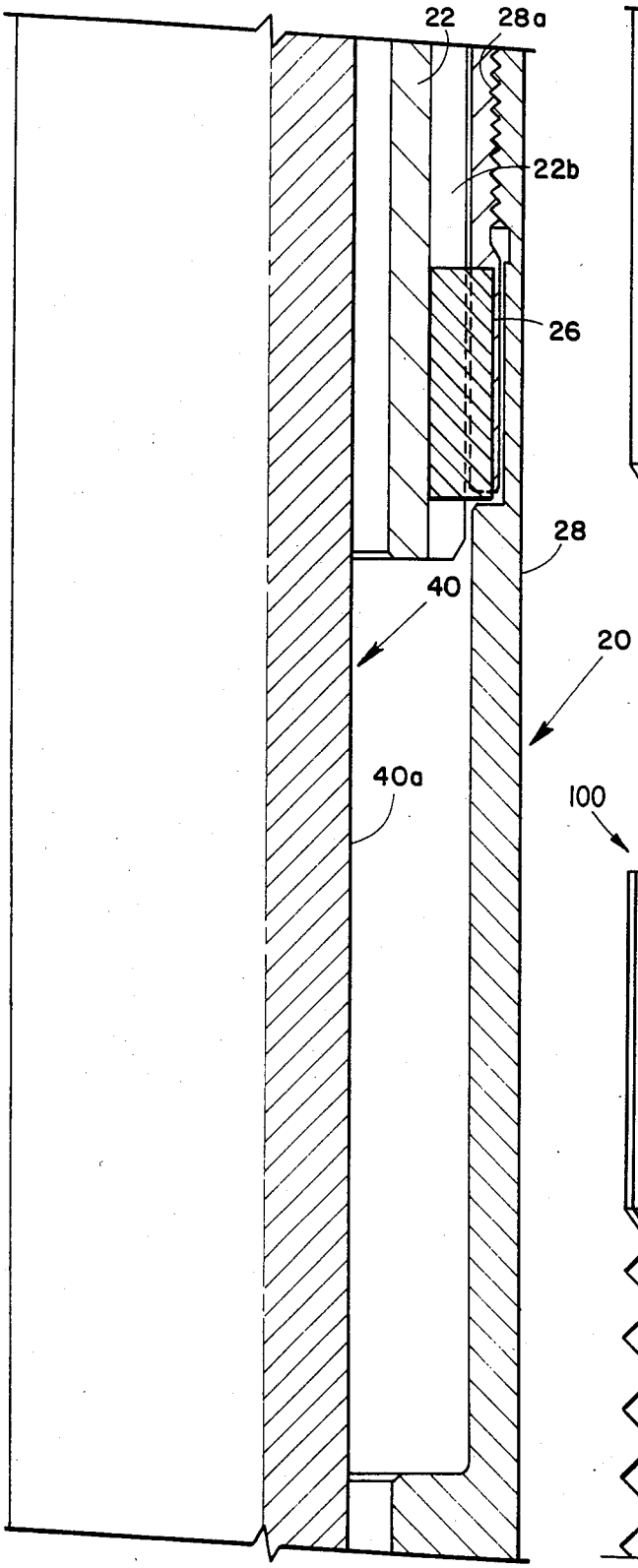
Figure 1F:
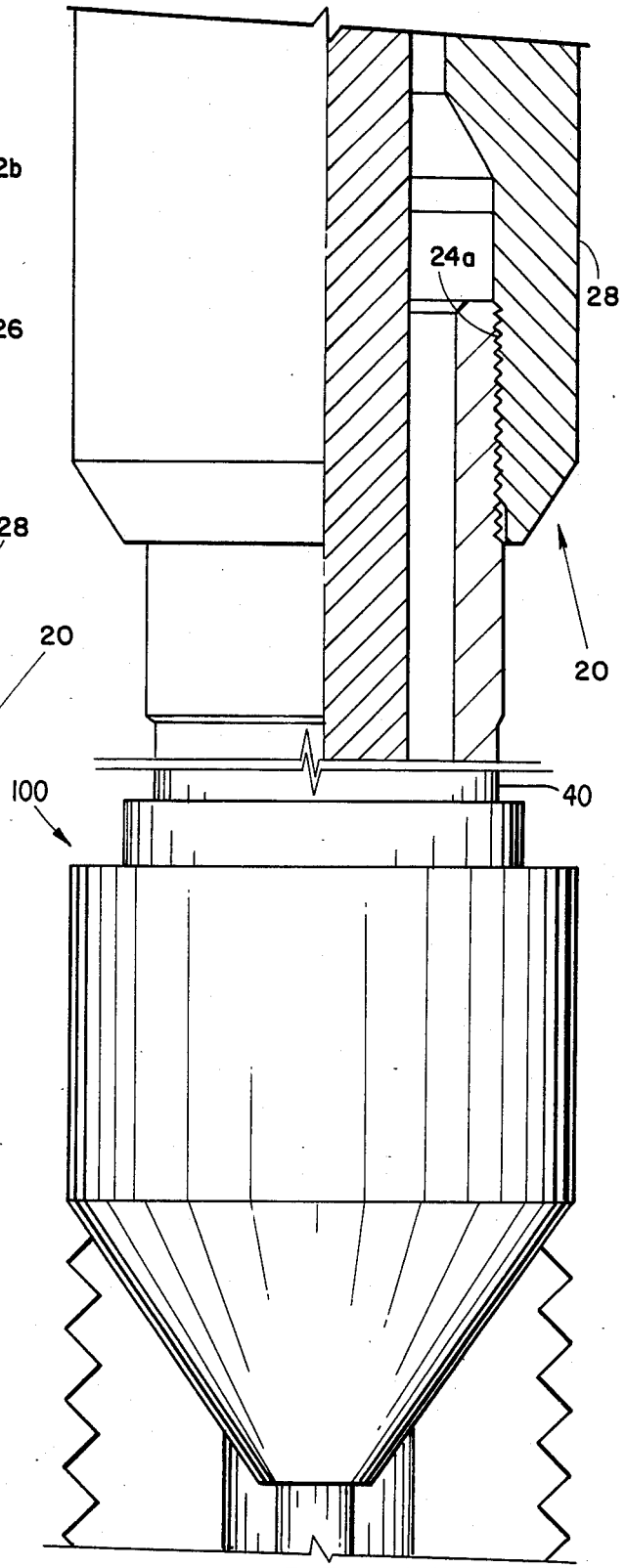
Figure 2A:
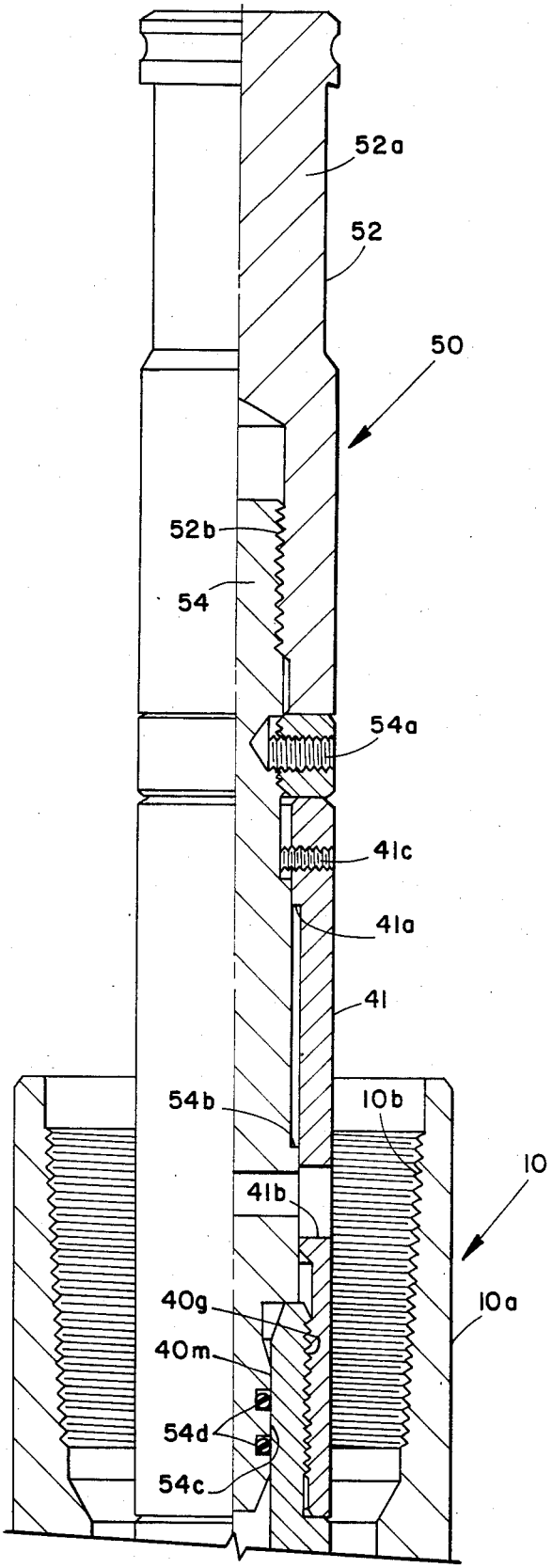
FIGS. 2A, 2B, 2C, 2D, 2E, and 2F are view respectively corresponding to FIGS. 1A, 1B, 1C, 1D, 1E, and 1F but showing the valve elements in their open positions.
Figure 2B:
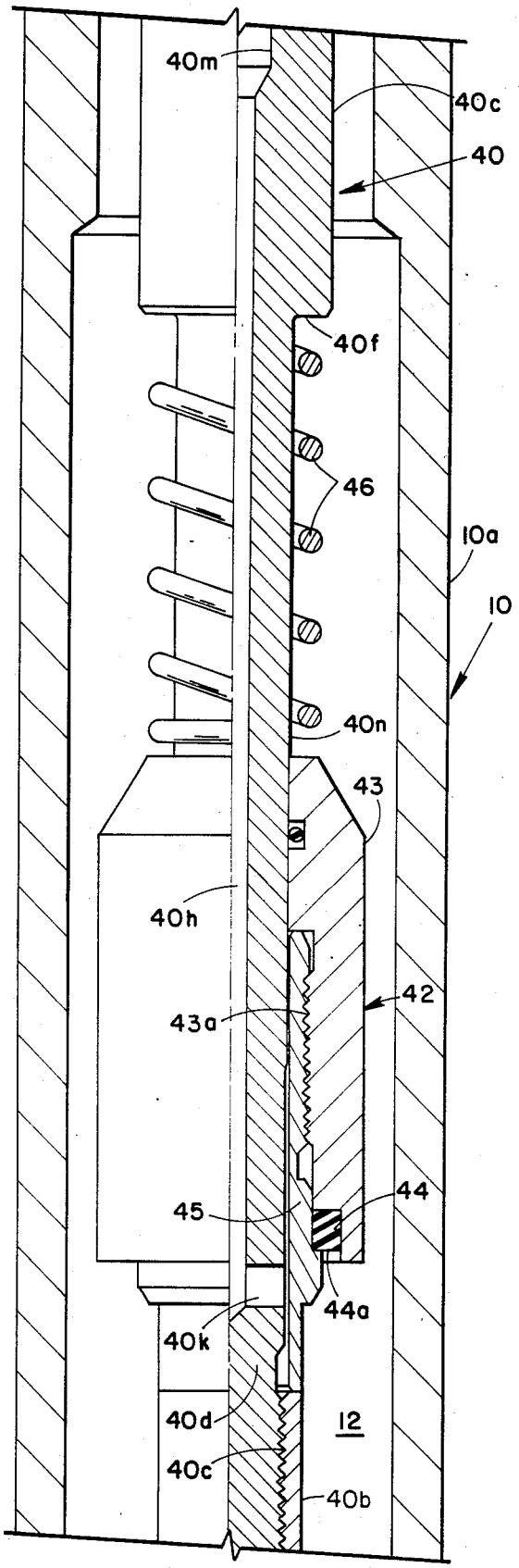
Figure 2C:
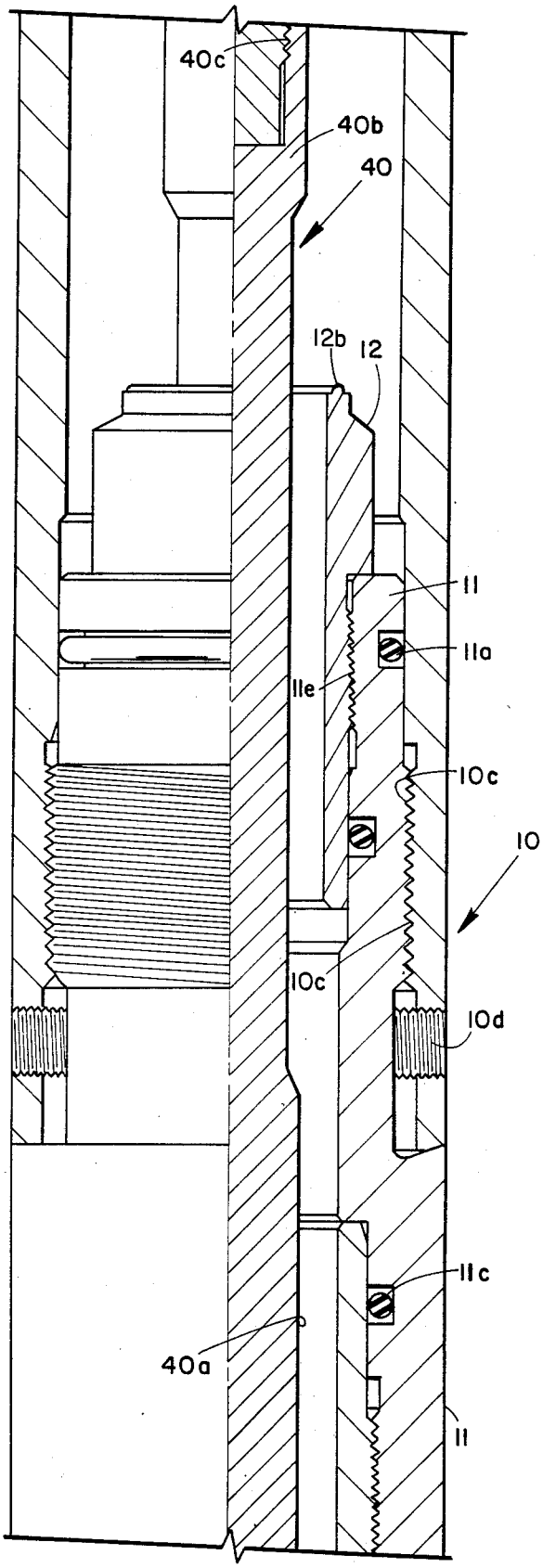
Figure 2D:
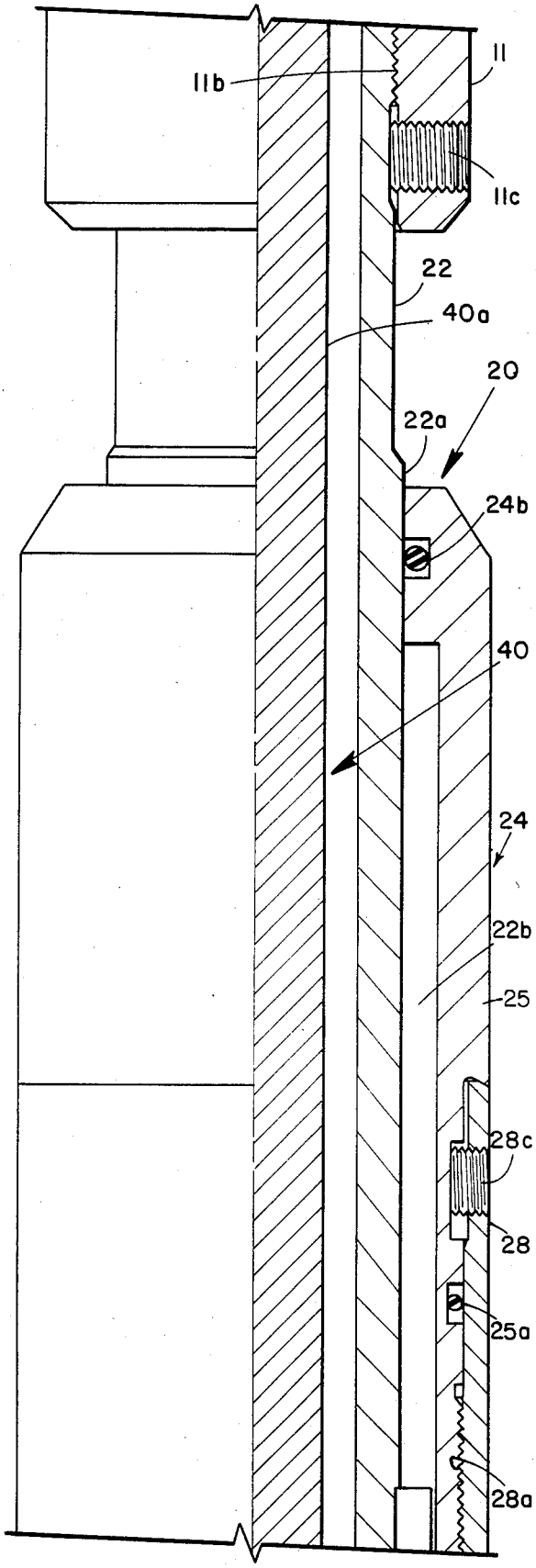
Figure 2E:
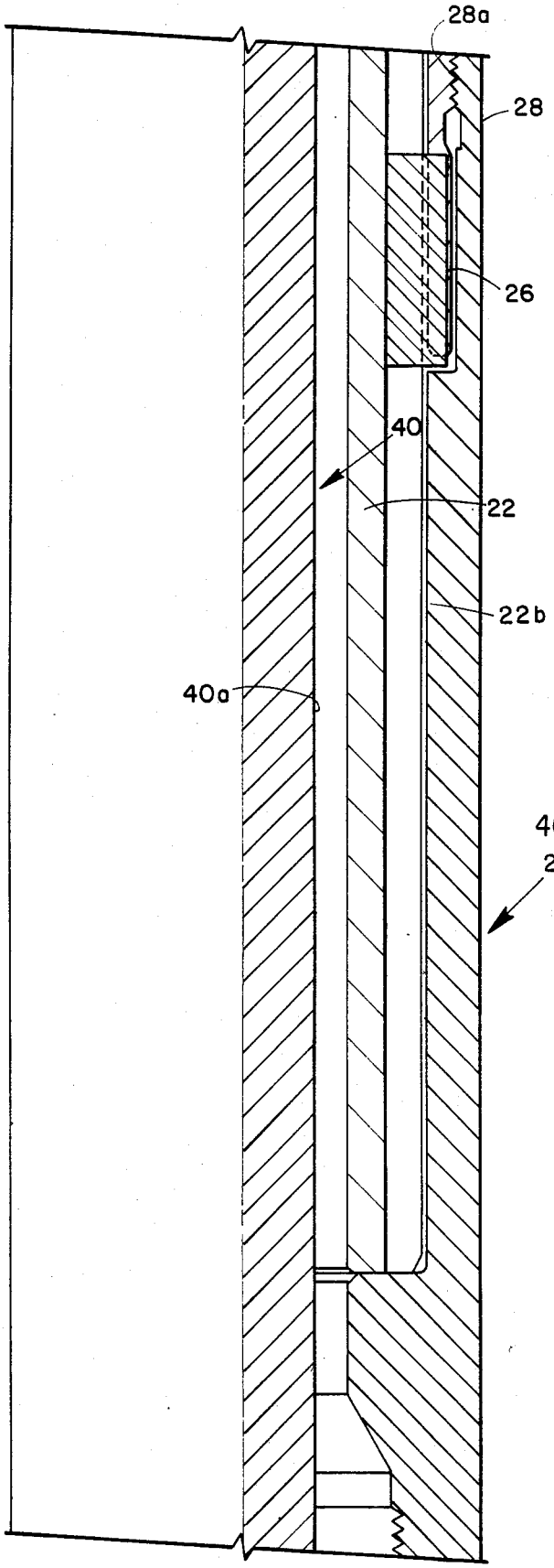
Figure 2F:
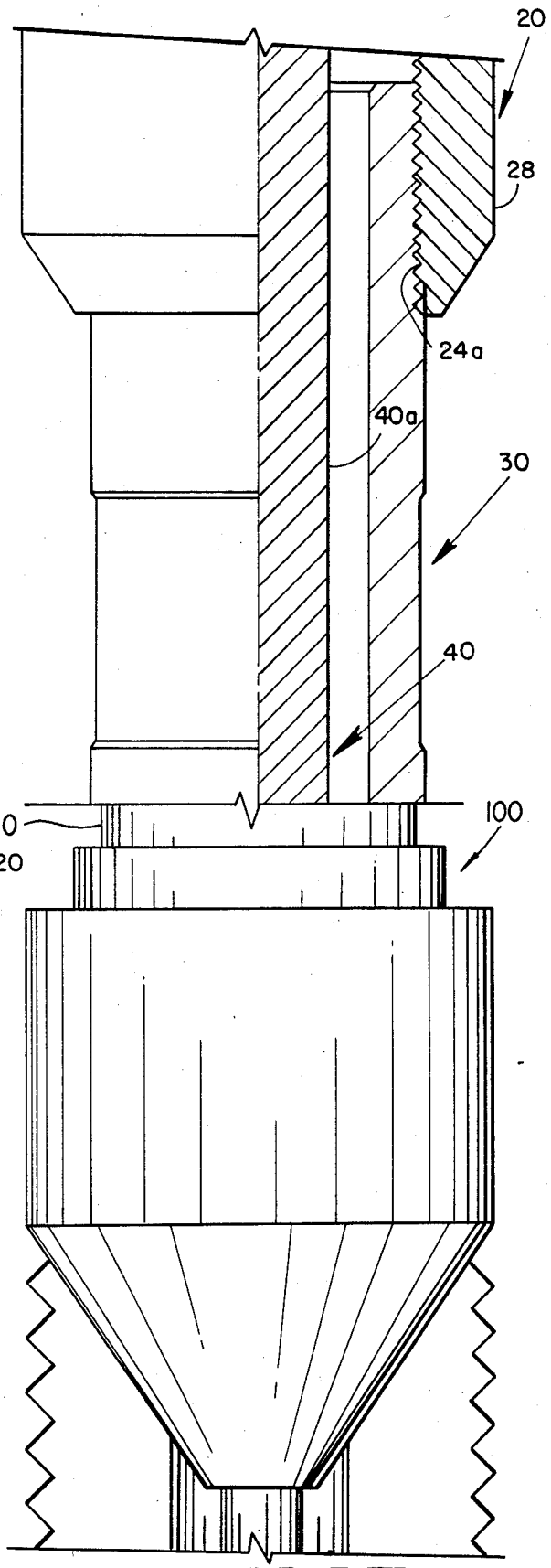

A first annular valve element 12 (FIG. 1B) is threadably secured to internal threads 11*e* provided in the top end of the connector sub 11. An O-ring 11*f* (FIG. 1C) seals this threaded connection. Annular valve element 12 extends axially upwardly and terminates in a valving protuberance 12*b* which will effect a sealing engagement with a second annular valve element 42 in a manner to be hereinafter described.

The aforedescribed elements constitute those components of the injection valving mechanism which may be permanently left downhole with the downhole tool or packer. It will be noted that the presence of these elements does not substantially obstruct the area of the axial passage provided by these elements between the bore of the tubing string and the bore of the downhole tool or packer (see FIGS. 4A and 4B).

To function as an injection valve, a second annular valve element 42 is mounted on support rod assembly 40 which extends downwardly through the entire length of the elements heretofore described and preferably is supported by an upwardly facing surface (not shown) provided on the downhole tool or packer 100 . Rod assembly 40 may thus be carried into the well with the injection valve assemblage and the packer or downhole tool, or may be subsequently lowered into position by wireline.

The support rod assembly 40 at its lower end comprises a solid rod 40*a* which extends from the lower portion of the valve housing 10 downwardly through the slip joint 20 and the conduit 30 into engagement with a suitable supporting surface (not shown) on the downhole tool or packer 100. Rod portion 40*a* terminates at its upper end in a cup-shaped portion 40*b* (FIG. 1C) which is provided with internal threads 40*c*. A bypass sleeve 40*d* is threadably secured at its lower end to the internal threads 40*c* and extends upwardly to a radially enlarged portion 40*e* which defines a downwardly facing surface 40*f* and external threads 40*g*. The bypass sleeve 40*d* defines an axial bypass passage 40*h* which terminates at its lower end in one or more radial ports 40*k*. The upper end of the bypass passage 40*h* is counterbored to provided a seal bore 40*m* for a purpose to be hereinafter described.

The external threads 40*g* provided on the top end of the bypass sleeve 40*d* threadably mount the lower end of a lost motion connecting sleeve 41 which defines an internal downwardly facing shoulder 41*a* which is engaged by an upwardly facing shoulder 54*b* of a fishing neck assembly 50 to remove the support rod assembly 40 from the well.

The fishing neck assembly 50 comprises a fishing neck element 52 having a solid top portion 52*a* and terminating in a hollow lower portion defining internal threads 52*b*. A lost motion connection rod 54 is threadably secured to internal threads 52*b* and defines the upwardly facing shoulder 54*b* previously mentioned which cooperates with the downwardly facing shoulder 48*b* of the support rod assembly 40. A set screw 54*a* secures a spacer ring 55 between the upper fishing rod portion 52 and the lost motion sleeve 41. A shear screw 41*c* normally prevents relative upward movement of the fishing neck assembly 50 with respect to the support rod assembly 40. The lower end of the lost motion rod 54 is provided with a plug portion 54*c* carrying 0-ring seals 54*d* which sealably cooperate with the seal bore 40*m* in the upper end of the axial bypass passage 40*h*.

Additionally, the portion 40*n* of the bypass sleeve 40*d* lying below the downwardly facing shoulder 40*f* is utilized to slidably and sealably mount the second annular valve element. The top end of upper portion 40*b* of the solid support rod 40*a* provides a stop for downward movement of second annular valve 42 relative to bypass sleeve 40*d*. The length of the rod assembly 40 is such that when it is in contact with the downhole tool or packer 100, and the slip joint 20 is contracted the second annular valve element 42 is disposed in a position spaced axially above the first annular valve element 12, thus providing the open position of the injection valve as shown in FIGS. 2A–2F.

The second annular valve element 42 comprises a threaded assemblage of an annular seal retainer 43 in overlying relationship to a seal sub 45. Threads 43*a* effect the interconnection. The seal retainer 42 and seal sub 45 cooperate to define an annular pocket at their lower ends of generally rectangular cross-sectional configuration within which an elastomeric seal element 44 is retained. A portion 44*a* of the bottom face of the annular seal element 44 is exposed and this portion is aligned with the upstanding sealing protuberance 12*b* formed on the first annular seal element 12 so that when the two annular seal elements 12 and 42 are moved into abutting engagement, a good seal is provided by the contact of protuberance 12*b* with the exposed face 44*a* of the elastomeric element 44.

As stated, seal retainer 43 is mounted for slidable, sealed movement along a limited length cylindrical surface 40*n* provided on the bypass sleeve 40*d* of support rod assembly 40. If desired, a light spring 46 may be provided between the upper end of the seal retainer 43 and the downwardly facing shoulder 40*f* defining the upper end of the cylindrical surface 40*n* so as to maintain the seal retainer 43 in an axially downwardly displaced position to more quickly engage and effect a seal with the first seal element 12 as such seal element is moved upwardly by upward movement of the tubing string. The spring 46 is not necessary to maintain the effectiveness of the seal between the annular elastomeric element 44 and the sealing protuberance 12*b*, since the presence of any fluid in the bore of the tubing string will create a fluid pressure differential urging the seal retainer 43 downwardly and effect a good sealing relationship between the two seal elements.

Those skilled in the art will readily appreciate the operation of the injection valve. When it is desired to move the injection valve from its open position shown in FIGS. 2A–2F, it is only necessary to elevate the tubing string by an amount sufficient to bring the first annular valve element 12, which is secured to the housing 10, upwardly into abutting engagement with the second annular valve element 42 as shown in FIGS 1A–1F. In this position, all fluid flow through the annulus surrounding the support rod assembly 40 is effectively prevented. To start fluid flow, it is only necessary to add weight to the tubing string to cause the slip joint 20 to move to its contracted position, and thus cause a separation of the first annular valve element 12 from the second annular valve element 42. In this connection, it should be noted that the second annular valve element 42 can only move downwardly relative to the support rod assembly 40 a limited amount since it encounters the upper end portion 40*b* of the lower portion 40*a* of the support rod assembly 40. Thus, positive opening and closing of the injection valving mechanism is assured and no reliance upon spring or fluid pressures is required. When the desired amount of upward tubing string movement is accomplished, the operator is assured that the injection valve is closed. Conversely, a corresponding downward movement of the tubing string will assure the opening of the injection valve. Hence, very accurate control of the amount of chemical treating fluid injected into the well may be readily obtained, and the operator need not be concerned in any manner with the fluid pressure conditions existing in the vicinity of the injection valve.

It sometimes happens, following a chemical treatment operation, that it is desirable to remove the support rod assembly 40 from the injection valving mechanism and thus open a large diameter flow passage through the injection valve housing 10 while it remains in a downhole location. This may be accomplished by the fishing neck assembly 50 attached to the upper end of the support rod assembly 40. If the injection valve is in its closed position, or any fluid pressure exists within the bore of the tubing string, it is highly desirable that pressure be equalized above and below the support rod assembly prior to attempting any upward withdrawal movement of the support rod assembly 40, since the upwardly facing end of such support rod assembly is subjected to a substantial downward pressure. In accordance with this invention, the fishing neck assembly 50 is not rigidly attached to the support rod assembly 40 but has a lost motion connection with support rod assembly 40, permitting limited upward movemnet of the fishing neck assembly relative to the support rod assembly 40 prior to engaging the support rod assembly 40 and moving it upwardly. This limited upward movement of the fishing neck assembly 50 is employed to open a small diameter bypass valve permitting fluid flow around the annular valve elements 12 and 42 to equalize the pressure on the support rod assembly 40.

Figure 3A:
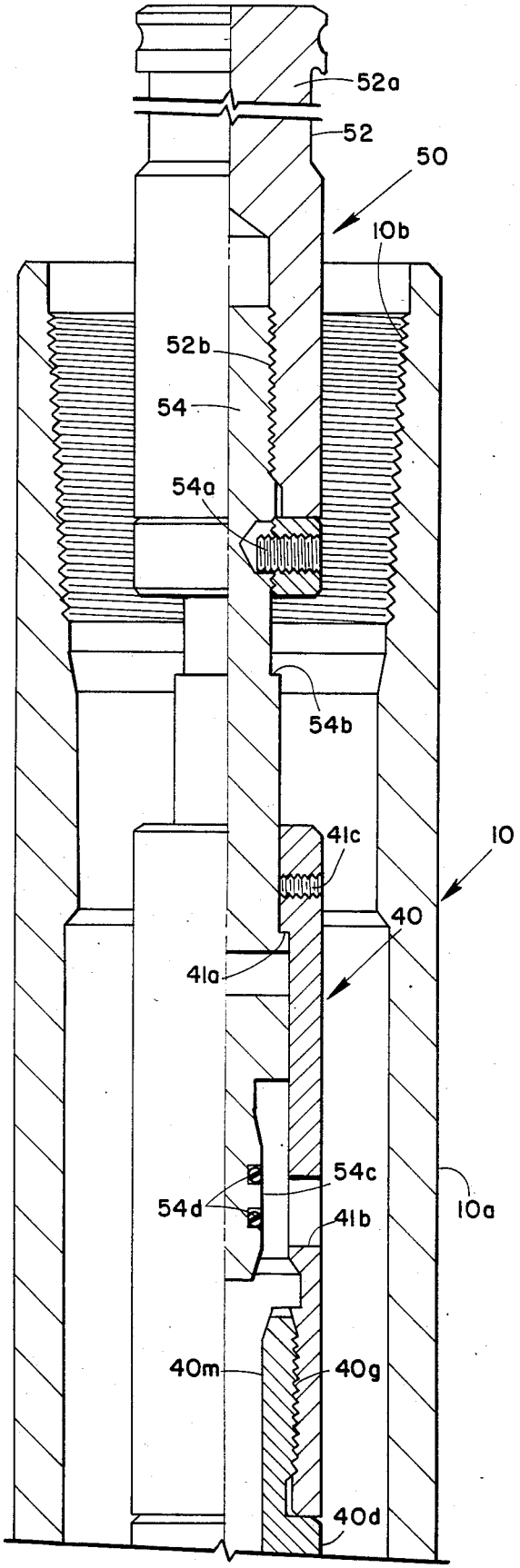
FIGS. 3A and 3B constitute views respectively similar to FIGS. 1A and 1B but illustrating the movement of the fishing neck to a pressure equalizing position preliminary to removing the central support rod assembly of the injection valve mechanism.
Figure 3B:
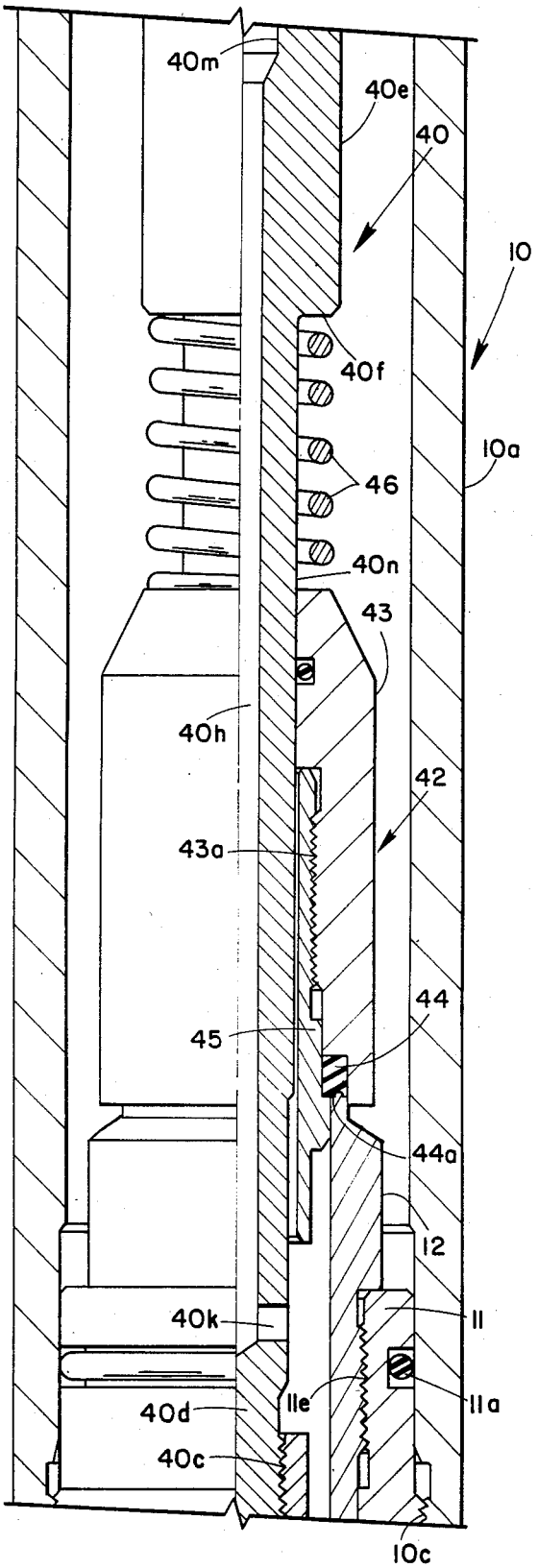
Figure 4A:
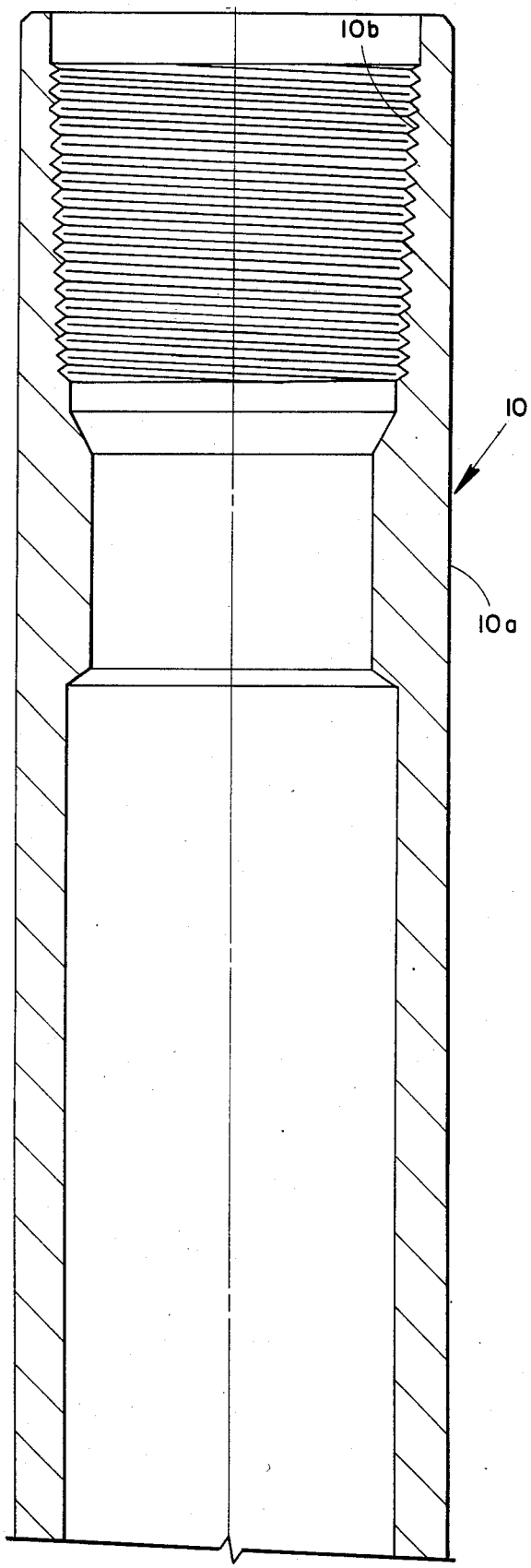
FIGS. 4A and 4B are views respectively corresponding to FIGS. 1A and 1B but illustrating the components of the injection valve mechanism left in the well after removal of the central support rod assembly.
Figure 4B:
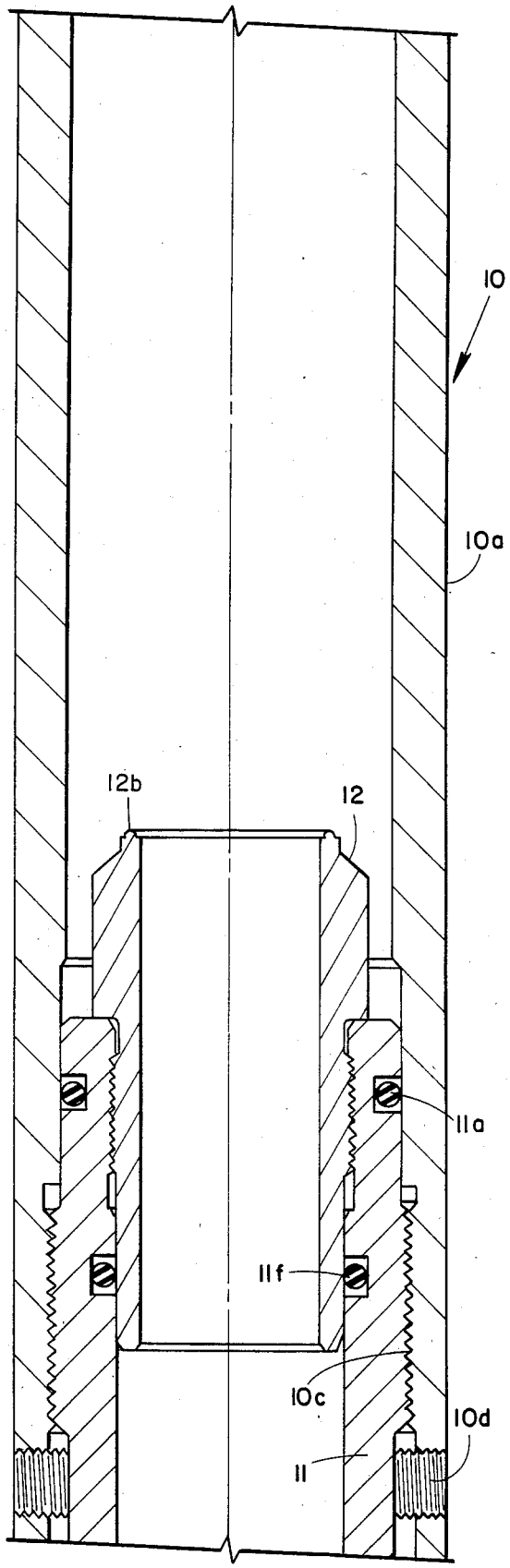

When the fishing neck 52 is engaged by an appropriate wireline fishing tool and an upward force applied thereto, the shear pin 41*c* will be sheared and the plug portion 54*c* of the lost motion rod 54 will be moved upwardly through a limited distance relative to the bypass sleeve 40*d*, thus moving the O-ring seals 54*d* out of sealing engagement with the counterbore 40*m* and establishing a bypass fluid passage around the valve elements 12 and 42 by virtue of flow through radial port 41*b*, thence through counterbore 40*m* and into the axial bypass passage 40*h* (FIGS. 3A and 3B). Hence the fluid pressure, if any, existing above and below the support rod assembly 40 of the injection valve will be effectively neutralized, and the entire support rod assembly 40, together with the second annular valve element 42 may be removed from the well by the interengagement of the shoulders 54*b* and 41*a* of the lost motion connection between the fishing neck assembly 50 and the support rod assembly 40. This leaves the remainder of the injection valving apparatus in the well, as shown in FIGS. 4A and 4B.

Obviously, the support rod assembly 40 may be reinserted in the injection valve and the injection valve permitted to function for any desired number of operations thereafter. It is therefore apparent that the injection valve embodying this invention provides the utmost flexibility in its operation since it may be cycled through any desired number of operations, and then in effect disabled through the removal of the support rod assembly 40 by the fishing neck assembly 50, then restored to an operative position by the reinsertion of the support rod assembly 40 by wireline, after replacing shear pin 41*c*. Thus, a selectively operable valving mechanism is provided for a tubing string which permits the selective removal of the bore constricting elements of the valving mechanism without impairing the ability of the valve to function when such elements are again restored.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Valving mechanism for a well conduit communicating with a downhole tool comprising a hollow valve housing connected in series relationship with the well conduit; a slip joint connected in series relationship with the well conduit intermediate said hollow valve housing and the downhole tool; whereby said hollow valve housing may be shifted axially by the well conduit without moving the downhole tool; a first annular valve element sealingly mounted within the bore of said hollow valve housing and axially shiftable with said valve housing; a support rod insertable within the bore of said hollow valve housing to define an annular fluid passage therebetween; a second annular valve element sealingly mounted on the exterior of said support rod, whereby axial movement of said valve housing in one direction moves said first and second valve elements into axially abutting engagement to close said annular fluid passage, thereby preventing fluid flow through the conduit to the downhole tool, and axial movement of said valve housing in the opposite direction axially separates said first and second valving elements and permits fluid flow from the conduit to the downhole tool.

2. The apparatus defined in claim 1 wherein an annular elastomeric element is mounted on the abutting face of one of said annular valve elements.

3. The apparatus defined in claim 2 wherein said second annular valve element is axially slidable relative to said support rod and is urged downwardly to compress said annular elastomeric element by the hydrostatic pressure of fluid in the conduit when said annular valve elements are disposed in said conduit closing position.

4. The apparatus of claim 1 wherein said support rod is supported by the downhole tool.

5. The apparatus of claim 1 wherein the conduit is moved upwardly to axially shift said first annular valve element into axial abutment with said second annular valve element.

6. The apparatus defined in claim 5 wherein an annular elastomeric element is mounted on the abutting face of one of said annular valve elements.

7. The apparatus defined in claim 6 wherein said second annular valve element is axially slidable relative to said support rod and is urged downwardly to compress said annular elastomeric element by the hydrostatic pressure of fluid in the conduit when said annular valve elements are disposed in said conduit closing position.

8. The apparatus of claim 5 wherein said support rod is supported by the downhole tool.

9. The apparatus defined in claim 1 further comprising a fishing neck secured to the upper end of said support rod, thereby permitting wireline removal of said support rod to provide an enlarged passage through said valve housing.

10. The apparatus defined in claim 9 wherein said fishing neck is upwardly movable relative to said support rod for a limited distance; and means responsive to said limited upward movement for equalizing the fluid pressure on said support rod to facilitate wireline removal thereof.

11. The apparatus defined in claim 9 wherein said support rod has an axially extending bore in its upper portion extending from its upper end to a point below the sealing engagement of said second annular valve element to said hollow valve housing; said fishing neck being mounted for limited upward movement relative to said support rod; and seal means disposed between said fishing neck and said axially extending bore; said seal means being opened by said limited upward movement of said fishing neck to equalize fluid pressure on said support rod and said second annular valve element.

12. An injection control valve for treating a production formation of a subterranean well comprising packer means settable above the formation to be treated; a hollow mandrel extending upwardly from said packer means; an upwardly facing abutment surface on said packer means located within said mandrel; a hollow valve housing; slip joint means connecting the lower end of said valve housing to the upper end of said mandrel; means for connecting the upper end of said valve housing to a tubing string; a support rod axially traversing said valve housing and said mandrel and supported by said upwardly facing abutment surface, thereby defining an annular fluid passage along the exterior of said support rod; a first annular valve element sealingly surrounding said rod; a second annular valve element sealingly secured to said hollow valve housing within the bore thereof, whereby axial movement in one direction of said hollow valve housing produced by the tubing string engages said first and second annular valve elements in sealing relation to close the fluid passage defined by the annulus surrounding said support rod.

13. The apparatus defined in claim 12 further comprising a fishing neck secured to the upper end of said support rod, thereby permitting wireline removal of said support rod to provide an enlarged passage through said valve housing and said mandrel.

14. The apparatus defined in claim 13 wherein said fishing neck is upwardly movable relative to said support rod for a limited distance; and means responsive to said limited upward movement of said fishing neck for equalizing the fluid pressure on said support rod to permit wireline removal thereof.

15. The apparatus defined in claim 13 wherein said support rod has an axially extending bore in its upper portion extending from its upper end to a point below the sealing engagement of said second annular valve element to said hollow valve housing; said fishing neck being mounted for limited upward movement relative to said support rod; and seal means disposed between said fishing neck and said axially extending bore; said seal means being opened by said limited upward movement of said fishing neck.

* * * * *